US011855403B2

(12) United States Patent
Chen et al.

(10) Patent No.: US 11,855,403 B2
(45) Date of Patent: Dec. 26, 2023

(54) CONNECTOR

(71) Applicant: Tyco Electronics (Shanghai) Co. Ltd., Shanghai (CN)

(72) Inventors: Bo Chen, Shanghai (CN); Hongbo Zhang, Shanghai (CN); Jianding Du, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 30 days.

(21) Appl. No.: 17/346,734

(22) Filed: Jun. 14, 2021

(65) Prior Publication Data

US 2021/0391659 A1 Dec. 16, 2021

(30) Foreign Application Priority Data

Jun. 15, 2020 (CN) ..... 202021097615.8

(51) Int. Cl.

| | |
|---|---|
| ***H01R 9/22*** | (2006.01) |
| ***H01R 4/18*** | (2006.01) |
| ***H01R 9/16*** | (2006.01) |
| ***H01R 12/58*** | (2011.01) |

(52) U.S. Cl.

CPC ..... *H01R 9/223* (2013.01); *H01R 4/184* (2013.01); *H01R 9/16* (2013.01); *H01R 12/585* (2013.01)

(58) Field of Classification Search

CPC ..... H01R 9/223; H01R 4/184; H01R 9/16; H01R 12/585; H01R 13/659; H01R 13/518

See application file for complete search history.

(56) References Cited

U.S. PATENT DOCUMENTS

| | | | | |
|---|---|---|---|---|
| 4,664,458 | A * | 5/1987 | Worth | H01R 12/52 439/82 |
| 6,224,428 | B1 * | 5/2001 | Chen | H01R 33/9655 439/918 |
| 2009/0156064 | A1 * | 6/2009 | Yoshida | H01R 13/5205 439/869 |
| 2009/0275222 | A1 * | 11/2009 | Wang | H01R 12/7023 439/82 |
| 2011/0244735 | A1 * | 10/2011 | Chen | H01R 12/724 439/731 |

FOREIGN PATENT DOCUMENTS

| | | | | |
|---|---|---|---|---|
| CN | 109066142 | A * | 12/2018 | |
| DE | 102010034790 | A1 * | 2/2012 | H01R 12/53 |
| EP | 2453526 | A1 * | 5/2012 | H01R 12/585 |
| WO | WO-2021160427 | A1 * | 8/2021 | |

OTHER PUBLICATIONS

Machine Translation CN-109066142-A, (Dec. 21, 2018) (Year: 2023).*

* cited by examiner

*Primary Examiner* — Travis S Chambers
(74) *Attorney, Agent, or Firm* — Barley Snyder

(57) ABSTRACT

A connector includes an insulation housing formed with a plurality of terminal slots, and a plurality of terminals inserted into the plurality of terminal slots. Each of the plurality of terminals has a pin protruding from a bottom of the insulation housing for insertion into a terminal hole in a circuit board. At least one latch is formed on the insulation housing for insertion and locking into a latch hole defined in the circuit board.

21 Claims, 6 Drawing Sheets

CONNECTOR

CROSS-REFERENCE TO RELATED APPLICATIONS

This application claims priority under 35 U.S.C. § 119 to Chinese Patent Application No. 202021097615.8, filed Jun. 15, 2020, the entire disclosure of which is incorporated herein by reference.

FIELD OF THE INVENTION

The present disclosure relates to an electrical connector, and more specifically, to an electrical connector for attaching to a circuit board.

BACKGROUND

In related prior arts, a connector generally comprises an insulation housing and a plurality of conductive terminals mounted in the insulation housing. The plurality of conductive terminals are usually arranged in a row, and the distance between two adjacent conductive terminals is the same. The plurality of conductive terminals are press-fitted into terminal slots in the circuit board in an interference fit manner, so that the entire connector is fixed to the circuit board. However, in these arrangements, the insulation housing of the connector remains separate from the circuit board as it is not directly fixed thereto. This leads to insufficient retention force between the connector and the circuit board. A resulting lack of stability often causes the conductive terminals of the connector to be skewed in the process of welding to the circuit board, resulting in poor connections.

SUMMARY

According to an embodiment of the present disclosure, a connector comprises an insulation housing formed with a plurality of terminal slots, and a plurality of terminals inserted into the plurality of terminal slots. Each of the plurality of terminals has a pin protruding from a bottom of the insulation housing for insertion into a terminal hole in a circuit board. At least one latch is formed on the insulation housing for insertion and locking into a latch hole in the circuit board.

BRIEF DESCRIPTION OF THE DRAWINGS

The invention will now be described by way of example with reference to the accompanying Figures, of which.

DETAILED DESCRIPTION OF THE EMBODIMENTS

Figure 1:
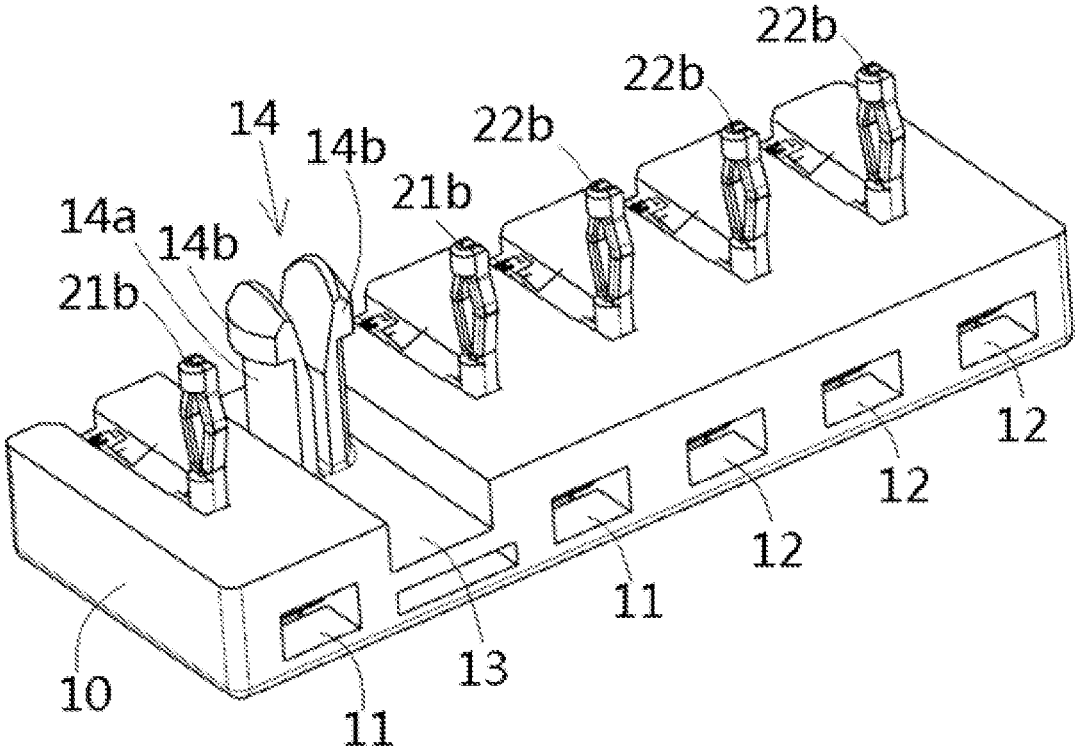
FIG. 1 shows a schematic three-dimensional diagram of a connector according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a connector comprises an insulation housing formed with a plurality of terminal slots, and a plurality of terminals inserted into the plurality of terminal slots. Each of the plurality of terminals has a pin protruding from the bottom of the insulation housing for insertion into a terminal hole in a circuit board. At least one latch is formed on the insulation housing for being inserted and locked into a latch hole in the circuit board.

Figure 6:
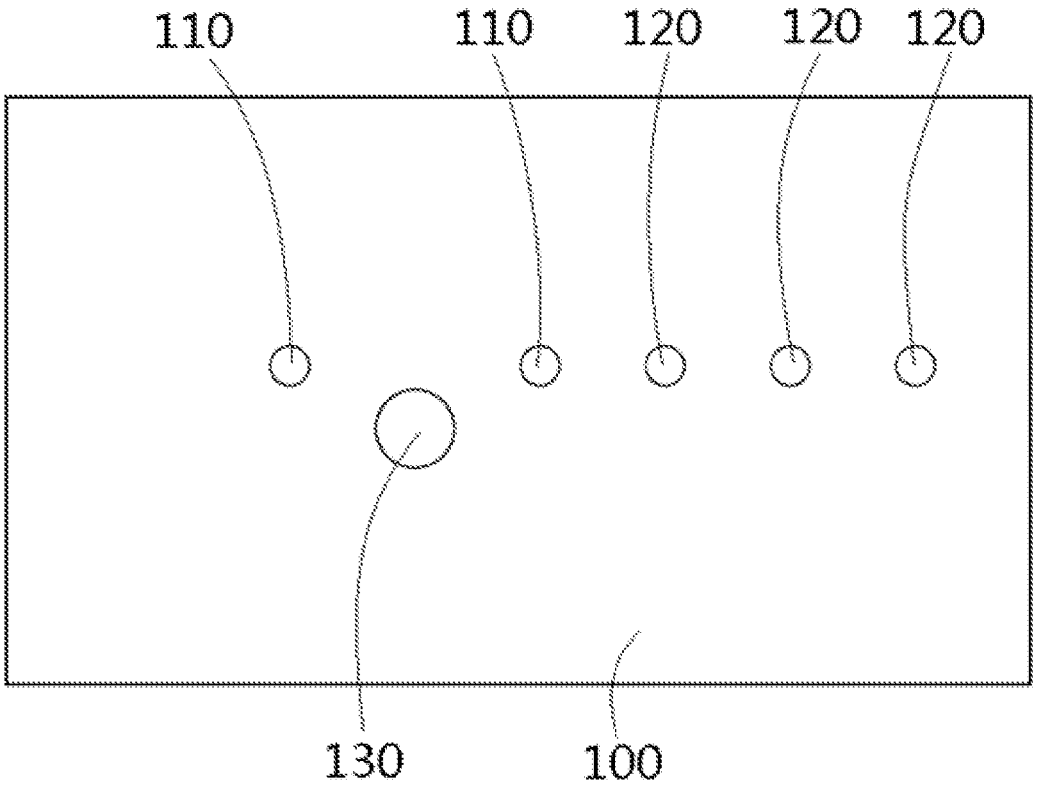
FIG. 6 shows a schematic diagram of a circuit board connected to the connector shown in FIG. 1.

FIG. 1 shows a schematic three-dimensional diagram of a connector according to an exemplary embodiment of the present disclosure, and FIG. 6 shows a schematic diagram of a circuit board connected to the connector shown in FIG. 1.

In the illustrated embodiment, as shown in FIGS. 1 and 6, the connector comprises an insulation housing 10 and a plurality of terminals 21, 22. The insulation housing 10 is formed with a plurality of terminal slots 11, 12. The plurality of terminals 21, 22 are inserted into the plurality of terminal slots 11, 12, respectively. Each of the terminals 21, 22 has a pin 21*b*, 22*b* protruding from the bottom of the insulation housing 10. The pin 21*b*, 22*b* of the terminals 21, 22 is adapted to be inserted into a terminal hole 110, 120 in a circuit board 100.

In the illustrated embodiment, as shown in FIGS. 1 and 6, at least one latch 14 (e.g., an elastic latch) is formed on the insulation housing 10, the elastic latch 14 being adapted to be inserted and locked into a latch hole 130 in the circuit board 100, so as to fix the connector on the circuit board 100. This can increase the retention force between the connector and the circuit board, thereby ensuring that the terminals of the connector are reliably soldered to the circuit board.

In the illustrated embodiment, as shown in FIGS. 1 and 6, each latch 14 includes a pair of elastic arms 14*a* facing each other and spaced apart from each other, a distal end of the elastic arm 14*a* is formed with a convex hook-shaped portion 14*b* on its outside. The pair of elastic arms 14*a* of the latch 14 are adapted to be inserted into the latch holes 130 in the circuit board 100, with the hook-shaped portion 14*b* on the pair of elastic arms 14*a* adapted to be locked into an edge portion of the latch hole 130 from a back side of the circuit board 100.

In the illustrated embodiment, as shown in FIGS. 1 and 6, a cross-section of each of the elastic arms 14*a* is semicircular, such that the pair of elastic arms 14*a* can be combined into a cylinder.

Figure 2:
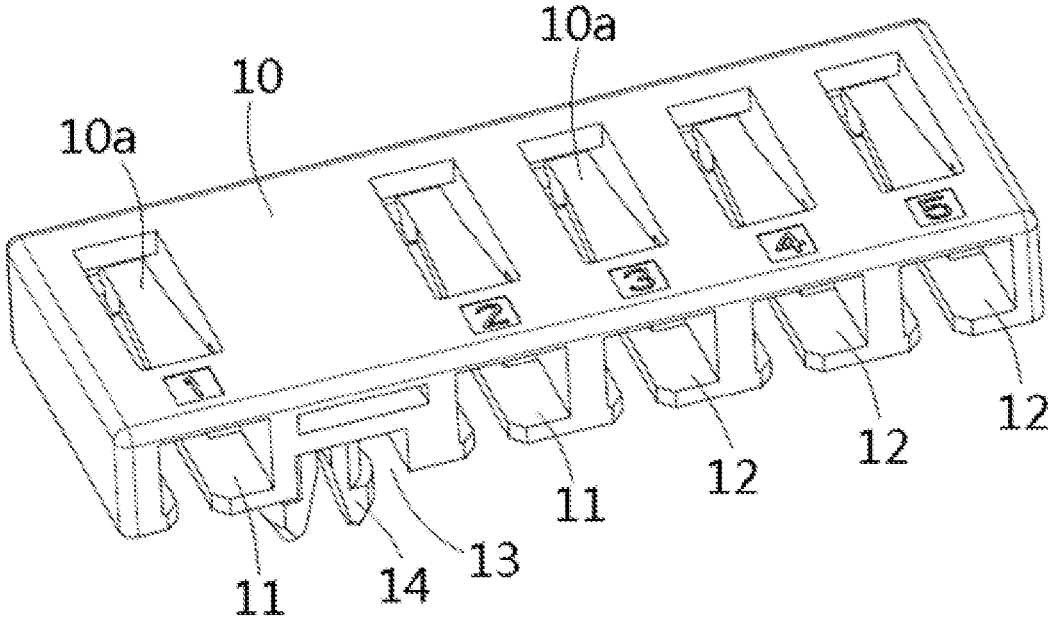
FIG. 2 shows a schematic three-dimensional diagram of the insulation housing of the connector shown in FIG. 1.
Figure 3:
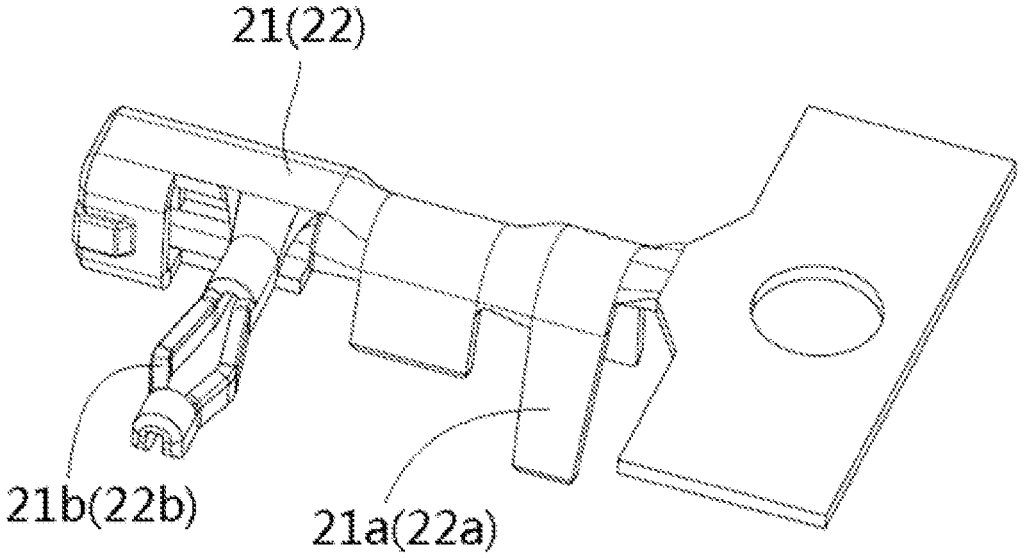
FIG. 3 shows a schematic diagram of a terminal of the connector shown in FIG. 1.

FIG. 2 shows a schematic three-dimensional diagram of the insulation housing of the connector shown in FIG. 1, and FIG. 3 shows a schematic diagram of a terminal of the connector shown in FIG. 1.

In the illustrated embodiment, as shown in FIGS. 1-3 and 6, the connector is a power connector. The plurality of terminal slots 11, 12 include two high-voltage terminal slots 11 and a plurality of low-voltage terminal slots 12, and the plurality of terminals 21, 22 include two high voltage terminals 21 inserted into the two high-voltage terminal slots 11, respectively, and a plurality of low-voltage terminals 22 inserted into the plurality of low-voltage terminal slots 12, respectively.

In the illustrated embodiment, as shown in FIGS. 1-3 and 6, the high-voltage terminal slots 11 and the high-voltage terminals 21 constitute a first connector suitable for a first voltage, and the low-voltage sockets 12 and the low-voltage terminals 22 constitute a second connector suitable for a second voltage, the first voltage being higher than the second voltage.

In the illustrated embodiment, as shown in FIGS. 1-3 and 6, the first voltage may be equal to 320V, and the second voltage may be equal to 50V. However, the present disclosure is not limited to this, and the first voltage and the second voltage may also be other voltage values.

In the illustrated embodiment, as shown in FIGS. 1-3 and 6, the insulation housing 10 is formed with a groove 13 separating the two high-voltage terminal slots 11 in its bottom surface, and the elastic latch 14 is located in the groove 13.

In the illustrated embodiment, as shown in FIGS. 1-3 and 6, the two high-voltage terminal slots 11 and the groove 13 are arranged on one side of the insulation housing 10, and the plurality of low-voltage terminal slots 12 are arranged on another side of the insulation housing 10.

In the illustrated embodiment, as shown in FIGS. 1-3 and 6, the distance between the two high-voltage terminal slots 11 is equal to twice the distance between two adjacent low-voltage terminal slots 12. In the present disclosure, because the two high-voltage terminal slots 11 are separated by the groove 13, the electrical interval or distance between the two high-voltage terminals 21 is increased, and electrical safety is improved.

In the illustrated embodiment, as shown in FIGS. 1-3 and 6, the groove 13 is located in the middle of the two high-voltage terminal slots 11 such that the distance between any one of the high-voltage terminal slots 11 and the groove 13 is equal to the distance between the two adjacent low-voltage terminal slots 12.

In the illustrated embodiment, as shown in FIGS. 1-3 and 6, the high-voltage slots 11 are exactly the same as the low-voltage slots 12, and the high-voltage terminals 21 are exactly the same as the low-voltage terminals 22. This reduces manufacturing costs.

In the illustrated embodiment, as shown in FIGS. 1-3 and 6, each of the terminal slots 11, 12 is formed with an elastic snap or latch 10*a* on its top wall. The elastic snap 10*a* is adapted to be snapped into or engaged with a recess in the terminals 21, 22 such that the terminals 21, 22 are held in the terminal slots 11, 12.

Figure 4:
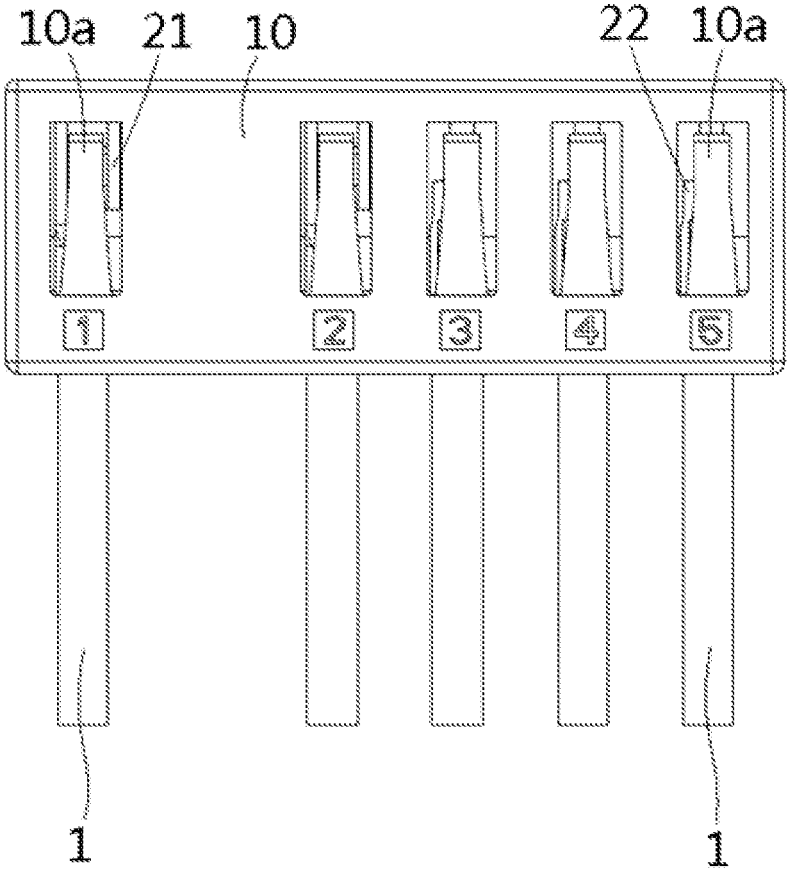
FIG. 4 shows a schematic diagram of the connection between the connector shown in FIG. 1 and a wire.

FIG. 4 shows a schematic diagram of the connection between the connector shown in FIG. 1 and a wire.

In the illustrated embodiment, as shown in FIGS. 1-4 and 6, each of the terminals 21, 22 further has a crimping end 21*a*, 22*a* adapted to crimp on a wire 1 so as to be electrically connected to the wire 1.

Figure 5:
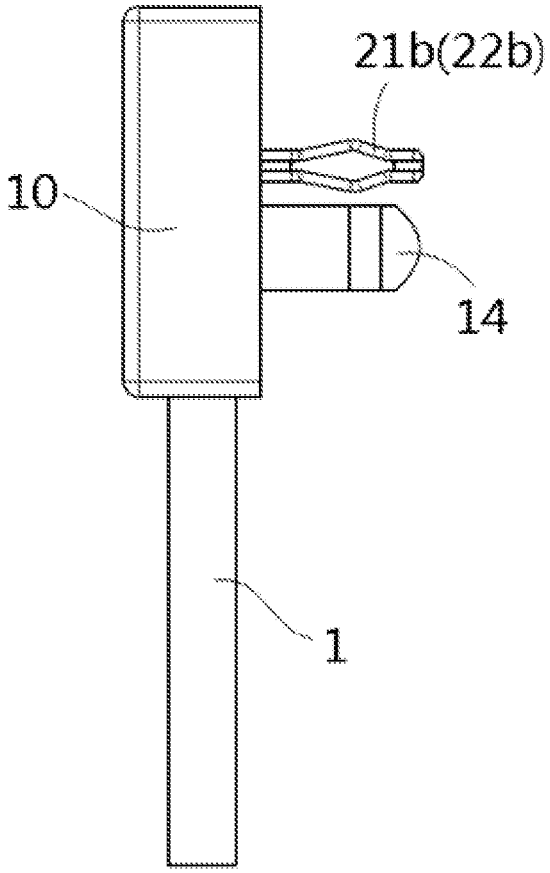
FIG. 5 shows a side view of the connector shown in FIG. 1.

FIG. 5 shows a side view of the connector shown in FIG. 1.

In the illustrated embodiment, as shown in FIGS. 1-6, the terminals 21, 22 are inserted into the terminal slots 11, 12 along a width direction of the insulation housing 10. The pins 21*b*, 22*b* of the plurality of terminals 21, 22 are arranged in a row, and the latch 14 and the pins 21*b*, 22*b* are staggered by a predetermined distance in an insertion direction of the terminals 21, 22.

In the illustrated embodiment, as shown in FIGS. 1-6, the pins 21*b*, 22*b* of each of the terminals 21, 22 are fish-eye-shaped, and adapted to be press-fitted to the terminal holes 110, 120 in the circuit board 100 in an interference fit manner.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector, comprising:

an insulation housing formed with a plurality of terminal slots extending through a width direction of the insulation housing and including at least one latch to be inserted into a circuit board; and a plurality of terminals inserted into the plurality of terminal slots, each of the plurality of terminals including a pin protruding from a bottom of the insulation housing to be inserted into a terminal hole in the circuit board, the plurality of terminal slots include two high-voltage terminal slots and a plurality of low-voltage terminal slots, and the plurality of terminals include two high voltage terminals inserted into the two high-voltage terminal slots, and a plurality of low-voltage terminals inserted into the plurality of low-voltage terminal slots.

2. The connector according to claim 1, wherein the high-voltage terminal slots and the high-voltage terminals constitute a first connector suitable for a first voltage, and the low-voltage terminal slots and the low-voltage terminals constitute a second connector suitable for a second voltage, the first voltage being higher than the second voltage.

3. The connector according to claim 1, wherein the high-voltage terminal slots are the same size and shape as the low-voltage terminal slots, and the high-voltage terminals are the same size and shape as the low-voltage terminals.

4. The connector according to claim 1, wherein each of the terminal slots is formed with an elastic latch on its top wall adapted to be engaged into a recess in the terminal for securing the terminal is held in the terminal slot.

5. The connector according to claim 1, wherein each of the terminals has a crimping end adapted to crimp on a wire.

6. The connector according to claim 1, wherein the terminals are inserted into the terminal slots along the width direction of the insulation housing, and the pins of the plurality of terminals are arranged in a row, the latch and the pins being staggered by a predetermined distance in an insertion direction of the terminals.

7. The connector according to claim 1, wherein the pins of each of the terminals are fish-eye-shaped, and adapted to be press-fitted to the terminal holes in the circuit board in an interference fit manner.

8. The connector according to claim 1, wherein each latch includes a pair of opposing elastic arms spaced apart from each other, a distal end of each of the elastic arms defines a convex portion on its outside for engaging with an edge portion of the latch hole on a back side of the circuit board.

9. The connector according to claim 8, wherein a cross-section of each of the elastic arms is semicircular such that the pair of elastic arms can be joined to define a cylindrical shape.

10. The connector according to claim 1, wherein the insulation housing is formed with a groove separating the two high-voltage terminal slots in its bottom surface, the at least one latch located in the groove.

11. The connector according to claim 10, wherein the two high-voltage terminal slots and the groove are arranged on one side of the insulation housing, and the plurality of low-voltage terminal slots are arranged on another side of the insulation housing.

12. The connector according to claim 11, wherein a distance between the two high-voltage terminal slots is equal to twice a distance between two adjacent low-voltage terminal slots.

13. The connector according to claim 12, wherein the groove is located in the middle of the two high-voltage terminal slots such that a distance between any one of the high-voltage terminal slots and the groove is equal to the distance between the two adjacent low-voltage terminal slots.

14. A connector, comprising:

an insulation housing, including:

a plurality of terminal slots for receiving a plurality of terminals;

a latch positioned between the plurality of terminal slots on the insulation housing for engaging with a latch hole in the circuit board;

a plurality of openings defined in the bottom of the housing for receiving a pin of each of the plurality of terminals therethrough for insertion into a respective terminal hole in the circuit board; and a plurality of terminals inserted into the plurality of terminal slots, the plurality of terminal slots including two first terminal slots and a plurality of second terminal slots, and the plurality of terminals including two first terminals inserted into the two first terminal slots, respectively, and a plurality of second terminals inserted into the plurality of second terminal slots, respectively.

15. The connector according to claim 14, wherein the plurality of openings define slots formed through the bottom of the housing and opening in an insertion direction of the plurality of terminals, each of the plurality terminal slots formed with an elastic snap for engaging with a recess in a respective terminal for securing the terminal within the slot.

16. The connector according to claim 14, wherein the insulation housing is formed with a groove in its bottom surface separating two of the plurality of terminal slots, the latch located in the groove.

17. The connector according to claim 16, wherein the latch comprises a pair of opposing elastic arms spaced apart from each other, a distal end of each of the elastic arms being formed with a protruding portion on its outside for engaging with the circuit board.

18. The connector according to claim 16, wherein the two first terminal slots and the groove are arranged on one side of the insulation housing, and the plurality of second terminal slots are arranged on another side of the insulation housing, wherein the groove is located in the middle of the two first terminal slots such that a distance between any one of the first terminal slots and the groove is equal to the distance between the two adjacent second terminal slots.

19. A connector, comprising:

an insulation housing formed with a plurality of terminal slots extending through a width direction of the insulation housing and including at least one latch to be inserted into a circuit board; and a plurality of terminals inserted into the plurality of terminal slots, each of the plurality of terminals including a pin protruding from a bottom of the insulation housing to be inserted into a terminal hole in the circuit board, each of the terminal slots is formed with an elastic latch on its top wall adapted to be engaged into a recess in the terminal for securing the terminal is held in the terminal slot.

20. A connector, comprising:

an insulation housing formed with a plurality of terminal slots extending through a width direction of the insulation housing and including at least one latch to be inserted into a circuit board; and a plurality of terminals inserted into the plurality of terminal slots, each of the plurality of terminals including a pin protruding from a bottom of the insulation housing to be inserted into a terminal hole in the circuit board, each of the terminals has a crimping end adapted to crimp on a wire.

21. A connector, comprising:

an insulation housing, including:

a plurality of terminal slots for receiving a plurality of terminals;

a latch positioned between the plurality of terminal slots on the insulation housing for engaging with a latch hole in the circuit board; and a plurality of openings defined in the bottom of the housing for receiving a pin of each of the plurality of terminals therethrough for insertion into a respective terminal hole in the circuit board, the plurality of openings define slots formed through the bottom of the housing and opening in an insertion direction of the plurality of terminals, each of the plurality terminal slots formed with an elastic snap for engaging with a recess in a respective terminal for securing the terminal within the slot.

* * * * *